US008556473B2

(12) United States Patent
Li et al.

(10) Patent No.: US 8,556,473 B2
(45) Date of Patent: Oct. 15, 2013

(54) LAMP WITH A TRUNCATED REFLECTOR CUP

(75) Inventors: Ming Li, Acton, MA (US); Steven C. Allen, Beverly, MA (US); Sarah Bazydola, Belmont, MA (US); Camil-Daniel Ghiu, Danvers, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 320 days.

(21) Appl. No.: 12/851,001

(22) Filed: Aug. 5, 2010

(65) Prior Publication Data

US 2012/0002423 A1 Jan. 5, 2012

Related U.S. Application Data

(60) Provisional application No. 61/360,423, filed on Jun. 30, 2010.

(51) Int. Cl.
*F21V 7/00* (2006.01)

(52) U.S. Cl.
USPC ..... 362/350; 362/249.02

(58) Field of Classification Search
USPC ..... 362/235, 249.02–249.06, 218, 350, 362/294, 345, 373, 800
See application file for complete search history.

(56) References Cited

U.S. PATENT DOCUMENTS

| | | | | |
|---|---|---|---|---|
| 7,461,951 | B2 | 12/2008 | Chou et al. | |
| 7,513,642 | B2 | 4/2009 | Sormani | |
| 2004/0240219 | A1 | 12/2004 | Oishi et al. | |
| 2005/0068787 | A1 | 3/2005 | Ishida | |
| 2007/0236958 | A1 | 10/2007 | Pang | |
| 2009/0002997 | A1 | 1/2009 | Koester | |
| 2009/0290356 | A1 | 11/2009 | Chen | |
| 2009/0323336 | A1 | 12/2009 | Kuo et al. | |
| 2010/0182784 | A1* | 7/2010 | Foo | 362/235 |

FOREIGN PATENT DOCUMENTS

| | | | |
|---|---|---|---|
| CN | 101 655 187 | A | 2/2010 |
| EP | 2 211 094 | A1 | 7/2010 |
| JP | 2007214100 | A | 8/2007 |

OTHER PUBLICATIONS

Prevot, Eric, International Search Report and Written Opinion for PCT/US11/39538, Oct. 14, 2011, pp. 1-9, European Patent Office, Rijswijk, The Netherlands.

* cited by examiner

*Primary Examiner* — Anne Hines
(74) *Attorney, Agent, or Firm* — Shaun P. Montana

(57) ABSTRACT

A lamp assembly, and method for making same. The lamp assembly includes first and second truncated reflector cups. The lamp assembly also includes at least one base plate disposed between the first and second truncated reflector cups, and a light engine disposed on a top surface of the at least one base plate. The light engine is configured to emit light to be reflected by one of the first and second truncated reflector cups.

18 Claims, 10 Drawing Sheets

LAMP WITH A TRUNCATED REFLECTOR CUP

CROSS-REFERENCE TO RELATED APPLICATION

The present application claims priority of U.S. Provisional Application No. 61/360,423, filed Jun. 30, 2010, the entire contents of which are hereby incorporated by reference.

GOVERNMENT RIGHTS

This invention was made with U.S. Government support under DOE Cooperative Agreement No. DE-EE0000611, awarded by the U.S. Department of Energy. The U.S. Government may have certain rights in this invention.

TECHNICAL FIELD

The present application relates to lamps and more particularly to a lamp including a truncated reflector cup.

BACKGROUND

Reflector-type lamps, such as multi-faceted reflector (MR) lamps and parabolic aluminized reflector (PAR) lamps, are well-known and are used in a wide variety of applications. In general, a reflector-type lamp includes a light source disposed adjacent to a reflector cup. The light source may include one or more light emitting diodes (LEDs), a gas discharge light source such as a fluorescent tube (e.g., in a compact fluorescent (CFL) lamp), and/or a high-intensity discharge (HID) light source. The interior surface of the reflector cup may be provided with a reflective coating and/or may be formed from a reflective material such as aluminum. Light from the light source may be imparted on the interior surface of the reflector cup and reflected outward from an end of the reflector cup. The interior surface of the reflector cup may take a variety of shapes, e.g. generally paraboloid, ellipsoid, sphero-ellipsoid, etc., and controls the direction and spread of light cast from the lamp.

FIG. 1 includes an exemplary plot 300 of light output intensity (candela) vs. angle (degrees) illustrating the simulated performance of a conventional parabolic reflector lamp that includes: six LEDs providing 100 lumens (lm) output each (600 lumens total) in a rectangular alignment; a reflector cup having 90% mirror interior surface, a 30 mm diameter, and approximately 17 mm length; and a phosphor shell with a 1.7 index of refraction, 4 mm outer radius and 3 mm inner radius. The plot 300 was generated by a simulation using 1,000,000 rays output from the light engine and produced a 4 Pi space efficiency (the total power with the reflector divided by the total power without the reflector) of 91%, indicating that 91% of the 600 lumens from the LEDs were directed out from the reflector cup. Also, as shown, the simulated lamp exhibits a maximum central beam candle power (CBCP), defined as the lumens per solid angle at a radiation center (0 degrees in the illustrated plot), of about 1415 candela (cd) with a beam angle at the full-width half-maximum (FWHM) luminance value (707.5 cd) of about 28.9 degrees.

SUMMARY

In some applications, it is desirable to more narrowly focus lamp output to provide a small beam angle. However, in a small form factor configuration, such as a conventional MR16 configuration, the smallest obtainable beam angle is limited by the ratio between the reflector cup surface area and the light source surface area. If conventional remote phosphor technology is used on a phosphor plate/dome, the phosphor plate/dome effectively becomes the light source, which is large compared with LED chips. The maximum CPCB in such a configuration is limited by dimensional restraints. Also, if a high light output level is desired in a small form factor lamp, thermal management may be an issue due to the limited amount of space available for effective heat sinking.

Embodiments of the present invention provide for one or more truncated reflector cups, as described in greater detail herein. Accordingly, a lamp including truncated reflector cups according to embodiments described herein may be configured to provide a smaller beam angle and higher maximum CBCP than a lamp including a full reflector cup in a package of comparable size. In addition, heat generated by light engines in a system according to embodiments described herein may be dissipated by base plates and a heat spreader without significantly adding to the size of the assembly.

In an embodiment, there is provided a lamp assembly. The lamp assembly includes first and second truncated reflector cups; at least one base plate disposed between the first and second truncated reflector cups; and a light engine disposed on a top surface of the at least one base plate, the light engine configured to emit light to be reflected by one of the first and second truncated reflector cups.

In a related embodiment, the first truncated reflector cup may have a first reflector cup side surface intersecting first and second associated end surfaces, and the second truncated reflector cup may have a second truncated reflector cup side surface intersecting first and second associated end surfaces, and the at least one base plate may be disposed between the first reflector cup side surface and the second reflector cup side surface. In a further related embodiment, the first reflector cup side surface may be in contact with the top surface of the at least one base plate. In another further related embodiment, the at least one light engine may include a light emitting diode having an emitting surface, and the first reflector cup side surface may be in a plane positioned closer to the emitting surface than the top surface of the at least one base plate.

In another related embodiment, the at least one base plate may include a thermally conductive material. In yet another related embodiment, the top surface of the base plate may include a reflective surface configured to reflect light incident thereon. In still another related embodiment, the assembly may include first and second ones of the base plates. In a further related embodiment, the light engine may be disposed on a top surface of the first base plate and may be configured to emit light to be reflected by the first truncated reflector cup, and the assembly may include a second light engine disposed on a top surface of the second base plate, the second light engine being configured to emit light to be reflected by the second truncated reflector cup.

In yet still another related embodiment, the first and second truncated reflector cups may have associated generally semi-paraboloid interior surfaces. In still yet another related embodiment, the assembly may further include a housing coupled to the first and second truncated reflector cups and at least one electrical lead extending from the light engine, through a bottom of at least one of the first and second truncated reflector cups and into the housing. In another related embodiment, the assembly may further include a housing coupled to the first and second truncated reflector cups and a ballast circuit disposed in the housing to provide an electrical output to the light engine. In yet another related embodiment, the assembly may further include a heat spreader thermally coupled to the at least one base plate.

In another embodiment, there is provided a lamp assembly. The lamp assembly includes first and second truncated reflector cups, the first truncated reflector cup having a first reflector cup side surface intersecting first and second associated end surfaces, and the second truncated reflector cup having a second truncated reflector cup side surface intersecting first and second associated end surfaces; at least one base plate disposed between the first truncated reflector cup side surface and the second truncated reflector cup side surface, the at least one base plate having a reflective top surface configured to reflect light incident thereon; and at least one light engine disposed on the top surface of the at least one base plate, the light engine comprising at least one light emitting diode having an emitting surface positioned to emit light toward the first truncated reflector cup, the first reflector cup side surface being in a plane positioned closer to the emitting surface than the top surface of the at least one base plate.

In a related embodiment, the at least one base plate may include a thermally conductive material. In a further related embodiment, the assembly may include first and second ones of the base plates. In a further related embodiment, the light engine may be disposed on a top surface of the first base plate, and the assembly may include a second light engine disposed on a top surface of the second base plate, the second light engine being configured to emit light to be reflected by the second truncated reflector cup.

In another related embodiment, first and second truncated reflector cups may have associated generally semi-paraboloid interior surfaces. In yet another related embodiment, the assembly may further include a housing coupled to the first and second truncated reflector cups and at least one electrical lead extending from the light engine, through a bottom of at least one of the first and second truncated reflector cups and into the housing. In still yet another related embodiment, the assembly may further include a housing coupled to the first and second truncated reflector cups and a ballast circuit disposed in the housing to provide an electrical output to the light engine.

In another embodiment, there is provided a method of assembling a lamp. The method includes providing first and second truncated reflector cups; positioning at least one base plate between the first and second truncated reflector cups; and providing a light engine on a top surface of the at least one base plate, the light engine configured to emit light to be reflected by one of the first and second truncated reflector cups.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
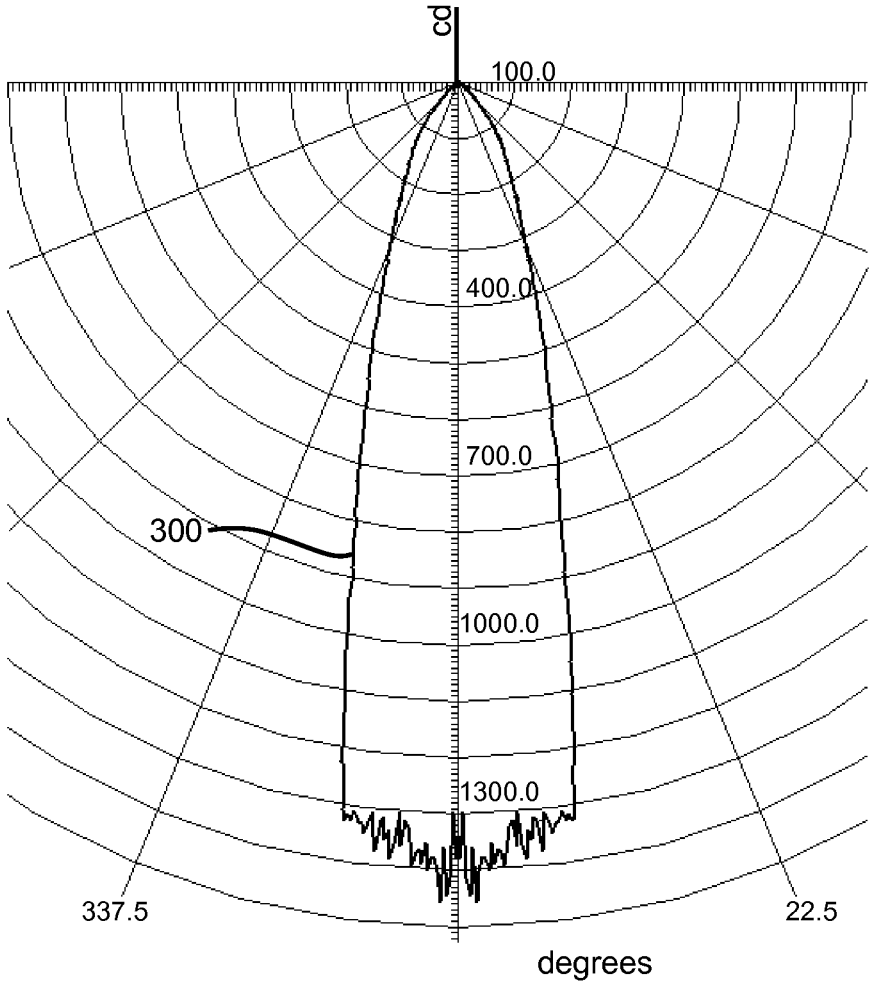
FIG. 1 includes plot of light output intensity (candela) vs. angle (degrees) illustrating the simulated performance of a conventional lamp assembly.

In general, a lamp according to embodiments described herein includes at least one truncated reflector cup with a light engine configured to emit light that is reflected by the interior surface of the truncated reflector cup and out of an open end of the truncated reflector cup. As used herein, the term "reflector cup" refers to a reflector having: a first end that receives at least a portion of a light engine, the light emitted therefrom, or one or more electrical leads therefor; an opposed second end from which light emitted by the light engine may be cast from the lamp; and an interior surface with a substantially continuous cross-section taken in a plane parallel to the first or second end and configured to reflect light from a light engine toward the second end. The term "reflector cup" thus includes, but is not limited to known parabolic, elliptical and sphero-elliptical reflector configurations including those with faceted interior surfaces. The term "truncated reflector cup" means a portion of a reflector cup, as may be realized, for example, by dividing a reflector cup along a plane intersecting the first end and the second end. A truncated reflector cup may thus be configured as one-half of a reflector cup, but may be more or less than half of a reflector cup, for example but not limited to, one-third of a reflector cup, one-fourth of a reflector cup, and so on. Thus, in some embodiments, a truncated reflector cup may have a semi-paraboloid or semi-elipsoid shape, among other shapes. Further, in some embodiments, the second end from which light is emitted by the light engine may not be entirely opposed to the first end (i.e., 180° degrees or approximately 180° away from the first end), but rather may be only partially opposed (for example but not limited to 170° and/or 190°, or approximately 170° or 190°), and alternatively or additionally, may be perpendicular to the first end, and alternatively or additionally, may be anywhere in the range of degrees from 0 to 360 with respect to the first end. For example, the light may come partially or entirely out of a side of a lamp, as opposed to the top or bottom (wherein the top or bottom is defined as the location that is opposite the light engine).

According to embodiments described herein, the interior surface of the reflector cup may terminate at a side surface that intersects first and second end surfaces. The light engine may be disposed on a base plate positioned adjacent to and substantially parallel to the side surface. The lamp may include first and second ones of the truncated reflector cups positioned with side surfaces in opposed relationship and with one or more base plates positioned therebetween. At least one light engine may be disposed on each base plate to emit light toward each truncated reflector cup, or a single light engine may be provided to emit light toward only one of the truncated reflector cups. Alternatively, or additionally, in embodiments where there are more than two truncated reflector cups, there may be a number of light engines provided that is one less than the number of truncated reflector cups, two less, three less, and so on. A truncated reflector cup configuration according to embodiments described herein produces a smaller beam angle compared to full-reflector cup configuration of the same size. A truncated reflector cup configuration according to embodiments described herein also allows for an enlarged heat spreader compared to a full reflector cup configuration of the same size.

Figure 2:
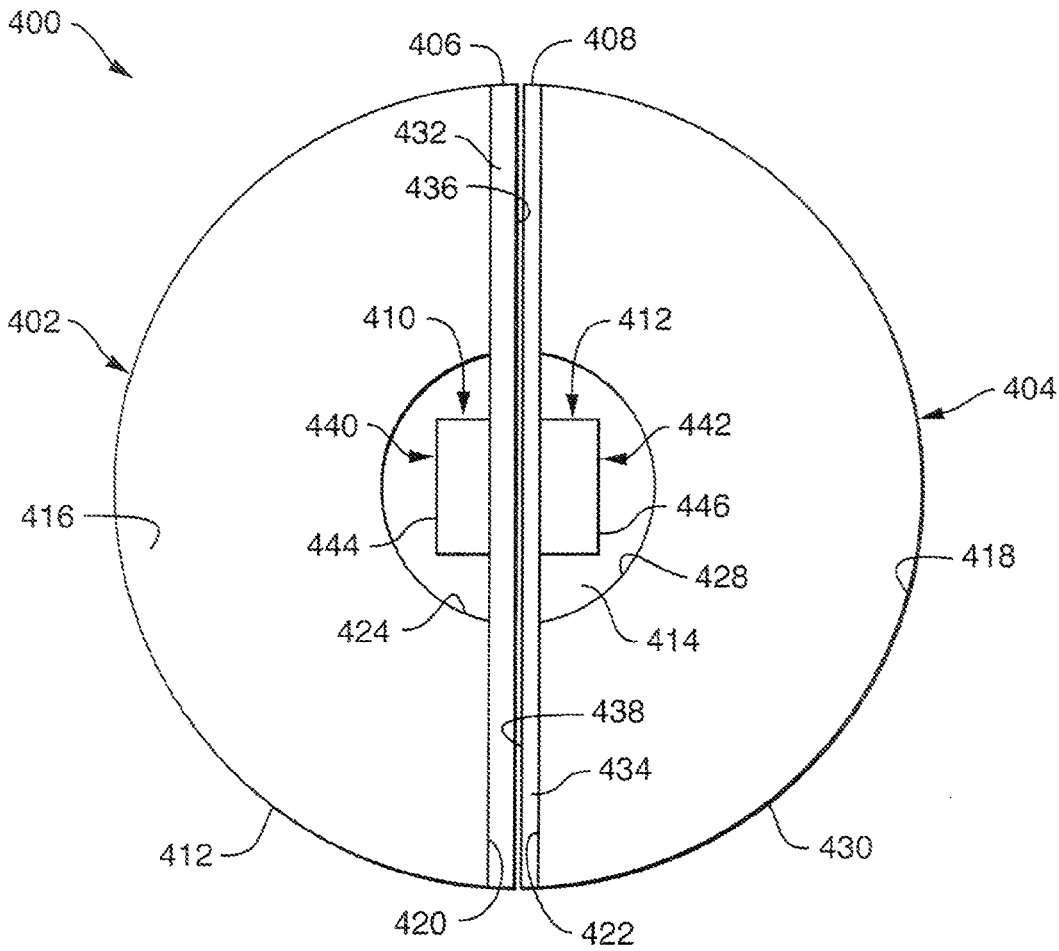
FIG. 2 is a front view diagrammatically illustrating an embodiment of a lamp assembly according to embodiments described herein.
Figure 3:
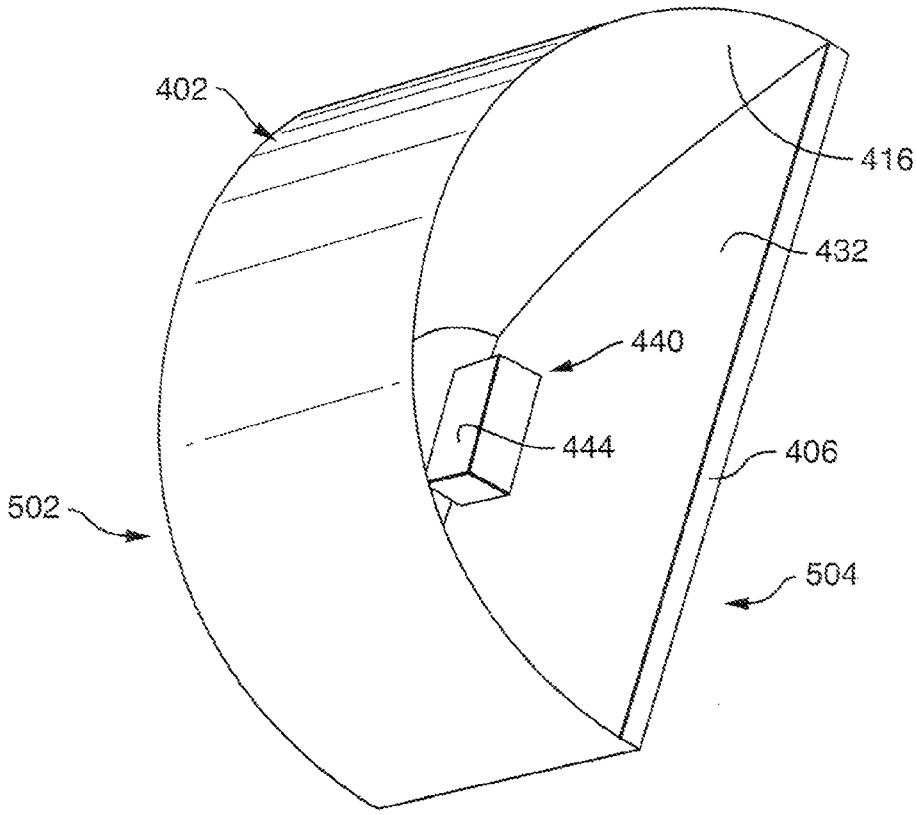
FIG. 3 is a perspective view of a portion of the lamp assembly shown in FIG. 2.

FIGS. 2 and 3 diagrammatically illustrate one embodiment 400 of a lamp including truncated reflector cups according to embodiments described herein. In the embodiments shown herein, the reflector cups may be illustrated and described with reference to a semi-parabolic reflector cup having an interior surface that is a portion of a paraboloid. It is to be understood, however, that a truncated reflector cup according to embodiments described herein is not limited to a semi-parabolic reflector cup. For example, a truncated reflector cup may alternatively be ellipsoid, semi-ellipsoid, or sphero-ellipsoid shaped, or combinations thereof. Additionally, or alternatively, a truncated reflector cup may have any shape in three dimensions, such as but not limited to a pyramid shape, a cubic shape, a cylindrical shape, and/or any other three-dimensional shape, and/or semi- or partial versions thereof, and/or of any combinations thereof. Additionally, or alternatively, any shape of a truncated reflector cup may, and in some embodiments, does, include portions which are faceted and/or multifaceted, including but not limited to the entire interior surface of a truncated reflector cup.

The illustrated embodiment 400 includes a first truncated reflector cup 402, a second truncated reflector cup 404, first 406 and second 408 base plates, first 410 and second 412 light engines and a heat spreader 414. Each truncated reflector cup 402, 404 includes an associated interior surface 416, 418 forming a portion of a paraboloid, i.e. each truncated reflector cup has a separate generally semi-paraboloid interior surface. For embodiments where a truncated reflector cup is not semi-parabolic, but rather of an alternative shape (for example, semi-ellipsoid), the interior surface of the truncated reflector cups, in combination, instead forms that alternative shape, and individually, each truncated reflector cup would form a portion of that alternative shape. The interior surface 416, 418 of each reflector cup terminates at a side surface 420, 422, respectively. The side surface 420 of the first truncated reflector cup 402 intersects first 424 and second 426 end surfaces of the first truncated reflector cup 402. The side surface 422 of the second truncated reflector cup 404 intersects first 428 and second 430 end surfaces of the second truncated reflector cup 404.

The first 406 and second 408 base plates are positioned with top surfaces 432, 434, respectively, thereof adjacent and substantially parallel to the side surfaces 420, 422 of the first and second truncated reflector cups, respectively, so that the base plates 406 and 408 are positioned between the truncated reflector cups 402, 404. The top surfaces 432, 434 of the base plates 406, 408 may contact the side surfaces 420, 422, respectively, of the truncated reflector cups 402, 404 or may be spaced therefrom. The first 410 and second 412 light engines are disposed on the top surfaces 432, 412, respectively, of the base plates 406, 408 and the back surfaces 436, 438 of the base plates 402, 404, respectively, are positioned adjacent each other in an opposed facing relationship. The back surfaces 436, 438 of the back plates may be spaced from each other, or may be in direct contact with each other.

The first 410 and second 412 light engines may take any known light engine configuration, and/or may include any known light source configuration such as one or more LEDs (with or without a remote phosphor element), a gas discharge light source such as a fluorescent tube (e.g., in a compact fluorescent (CFL) lamp), and/or a high-intensity discharge (HID) light source, among others. As used herein, "LED" means any solid state light source, including light emitting diode(s) (LED or LEDs), organic light emitting diode(s) (OLED or OLEDs), and the like. The singular term "LED" may thus refer to a single LED die on a chip having one or more LED dies, and/or to the chip itself which contains one or more LED dies, and/or to an array (i.e., plurality) of chips, each including one or more LED dies, grouped together. In any of these instances, phosphor and/or phosphors as well as optics and other associated components may also be present. In the illustrated embodiment of FIG. 2, each light engine 410, 412 includes LEDs 440, 442, having an emitting surface 444, 446, respectively, from which light is emitted from the LED in the direction illustrated by arrow A in FIG. 3. Although only one LED 440, 442, is shown on each base plate 406, 408 it is to be understood that any number of LEDs may be provided on the base plate. The emitting surface 444, 446 of each of the LEDs 440, 442 is positioned substantially parallel to the top surface 432, 434 of the base plate to which it is attached and in opposed facing relationship to the interior surface 416, 418 of the associated truncated reflector cup 402, 404.

The base plates 406, 408 may be configured as printed circuit boards (PCBs) including electronics and/or conductive traces and electrical leads thereon receiving an electrical input and energizing the light engines 410, 412. The base plates 406, 408 may be thermally conductive and may be thermally coupled to the heat spreader 414 and, optionally, directly to the end surfaces 424, 428 at the first end, i.e. end 502 in FIG. 3, of the truncated reflector cups. The term "coupled" as used herein refers to any connection, coupling, link, or the like and does not require a direct physical and/or electrical connection. As used herein, "thermally coupled" refers to such a connection, coupling, link, or the like that allows heat to be transferred from one element to the other thermally coupled element.

The heat spreader 414 may include a known thermally conductive material for conducting and dissipating heat from the base plates 406, 408 and/or the truncated reflector cups 402, 404. Heat generated by the LEDs 440, 442 and electronics on the base plates 406, 408 may thus be distributed and dissipated by the base plates 406, 408 and the heat spreader 414. The top surfaces 432, 434 of the base plates 406, 408, respectively, may be reflective so that light emitted by the light engines 410, 412 and/or reflected from the interior surfaces 416, 418 of the truncated reflector cups 402, 404 is reflected from the top surfaces 432, 434 of the base plate and toward the second end, i.e. end 504 in FIG. 3, of the truncated reflector cups. A reflective top surface 432, 434 may be established on one or more of the base plates 406, 408 by providing a known reflective coating on the top surfaces 432, 434 of the base plate, or by constructing the base plates 406, 408 from a reflective material, so that a majority of the portion of the top surfaces 432, 434 opposed to the interior surfaces 416, 418 of the truncated reflector cups is reflective. In one embodiment, the reflective top surfaces 432, 434 of the base plates may reflect at least 90% of the light incident thereon.

Although the illustrated embodiment shown in FIG. 2 includes the first 406 and second 408 base plates with the first 410 and second 412 light engines, respectively, a lamp according to embodiments described herein may include only a single base plate and/or only a single light engine. In some embodiments, for example, a single base plate may be provided with a light engine and/or reflective surfaces on either one or both sides of the base plate. In embodiments with a single light engine on one side of a base plate, the side on which the light engine is affixed may be reflective, while the opposed side may carry electronics and/or conductive traces coupled to the light engine.

In the illustrated embodiment shown in FIG. 2, therefore, the two separate truncated reflector cups 402, 404 with the associated base plates 406, 408 and the light engines 410, 412 are combined to form the lamp assembly 400. The back surfaces 436, 438 of the base plates 406, 408 may be placed in opposed facing relationship to each other. The back surfaces 436, 438 of the base plates 406, 408 may be either in direct contact with each other or spaced from each other, e.g. by a few millimeters in some embodiments, and mechanically secured in that position, e.g. by fasteners. With such a configuration, and with the emitting surfaces 444, 446 of the light engines 410, 412 positioned in opposed facing relationship to the interior surfaces 416, 418 of the truncated reflector cups 402, 404, respectively, light from the light engines 410, 412 is emitted toward the interior surfaces 416, 418, respectively, of the truncated reflector cups 402, 404 and reflects therefrom and/or from the top surfaces 432, 434 of the base plates 406, 408 and is indirectly emitted from the second end (e.g. end 504) of the truncated reflector cups 402, 404.

Figure 4:
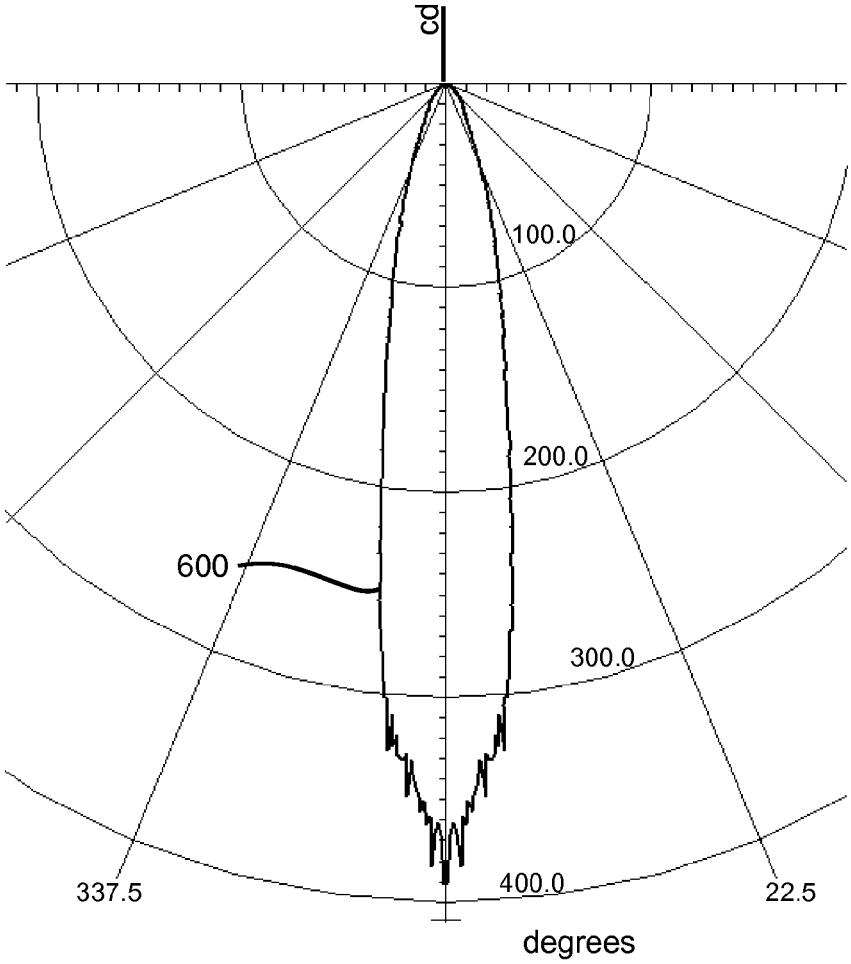
FIG. 4 includes plot of light output intensity (candela) vs. angle (degrees) illustrating the simulated performance of a lamp assembly as shown in FIG. 3.

FIG. 4 includes an exemplary plot 600 of light output intensity (candela) vs. angle (degrees) illustrating the simulated performance of a lamp according to embodiments described herein that include a single truncated reflector cup, light engine and base plate, as shown, for example, in FIG. 3. The plot 600 shown in FIG. 4 was generated with the light engine providing a 100 lumens output, a truncated reflector cup having 90% mirror surface, a 30 mm diameter and approximately 17 mm length, and a base plate having a 99% scattering surface. The plot 600 was generated by simulating 1,000,000 light rays output from the light engine and produced a 4 Pi space efficiency (the total power with the reflector divided by the total power without the reflector) of 87.5%, indicating that 87.5% of the 100 lumens from the light engine were directed out from second end of the reflector. Also, as shown, the simulated lamp exhibits a maximum central beam candle power (CBCP) of 391 candela (cd) for the 100 lumens light engine with a beam angle at the full-width half-maximum (FWHM) luminance value (195.5 cd) of about 18.5 degrees. The maximum CBCP of the lamp is proportional to the output of the light source. For example, a light engine providing a 600 lumens output would produce a maximum CBCP that is six times greater than the CBCP of 391 candela shown in the plot, i.e. a 600 lumens output would produce a maximum CBCP of 2346 candela. For comparable light engine lumens output, a lamp having a configuration as shown in FIG. 3 and the parameters described above thus produced a simulated output having a significantly smaller beam angle and a significantly higher maximum CBCP compared to a lamp as shown and described in connection with FIGS. 1-3.

Figure 7:
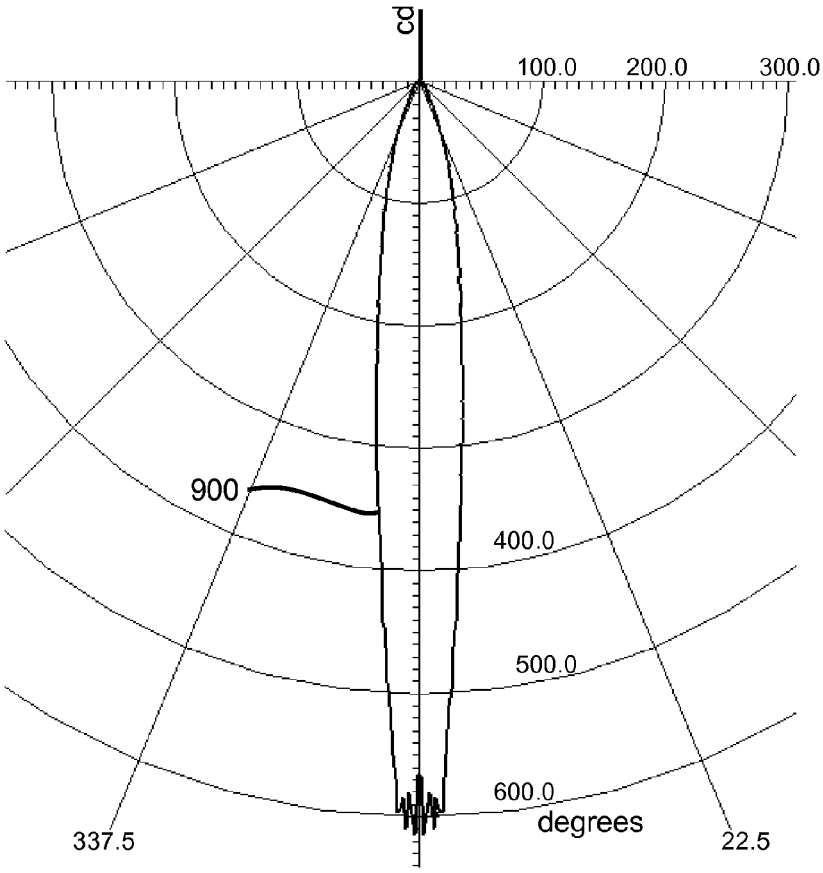
FIG. 7 includes plot of light output intensity (candela) vs. angle (degrees) illustrating the simulated performance of a lamp assembly as shown in FIG. 6.
Figure 8:
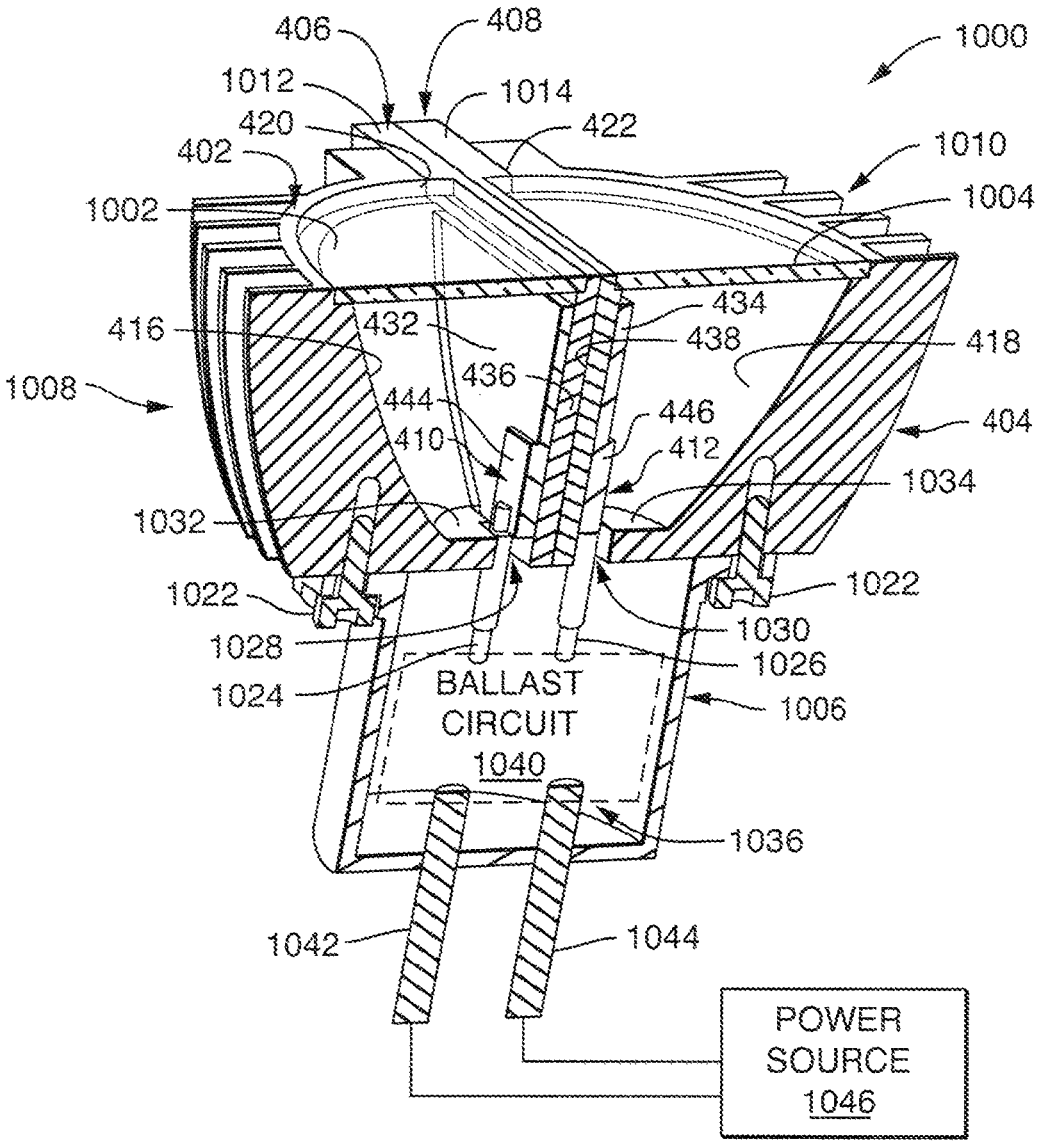
FIG. 8 is a cross-sectional view of another embodiment of a lamp assembly according to embodiments described herein.

FIGS. 7 and 8 diagrammatically illustrate another embodiment 700 of a lamp including the truncated reflector cups 402, 404 according to embodiments described herein. The embodiment illustrated in FIGS. 7 and 8 is substantially the same as the embodiment illustrated in FIGS. 4 and 5, except the side surfaces 420, 422 of the truncated reflector cups 402, 404, respectively, are spaced from the top surfaces 432, 434 of the base plates 406, 408, respectively, by respective distances D1 and D2. The distances D1 and D2 may be approximately the same, or may be different from each other, and may be any distance that allows light emitted from the light engine to be reflected by the interior surfaces 416, 418 reflector cups. In some embodiments, the distances D1 and D2 may be selected such that planes defined by the side surfaces 420, 422 of the truncated reflector cups 402, 404 are closer to the emitting surfaces 444, 446 of the LEDs 440, 442 than to the top surfaces 432, 434 of the base plates 406, 408. In the illustrated embodiment shown in FIG. 5, for example, the planes defined by the side surfaces 420, 422 of the truncated reflector cups 402, 404 are approximately aligned with the emitting surfaces 444, 446 of the LEDs 440, 442.

Figure 5:
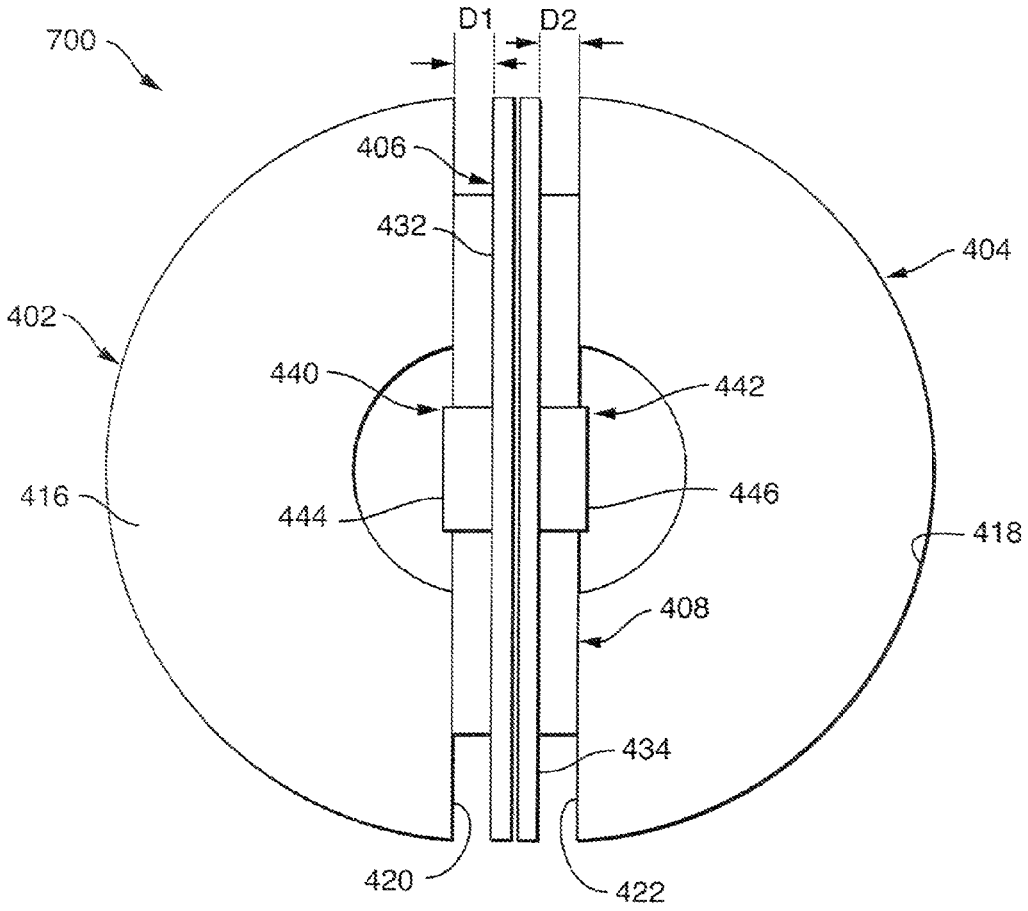
FIG. 5 is a front view diagrammatically illustrating another embodiment of a lamp assembly according to embodiments described herein.

Although the illustrated embodiment 700 of FIG. 5 illustrates two truncated reflector cups 402, 404 spaced from the top surfaces 432, 434 of the base plates 406, 408, respectively, it is to be understood that only one of the side surfaces 420, 422 may be spaced from its associated base plate, while the other may be in contact with its associated base plate. Also, as described above, a lamp according to embodiments described herein may include only a single light engine and/or single base plate instead of two separate base plates.

Figure 6:
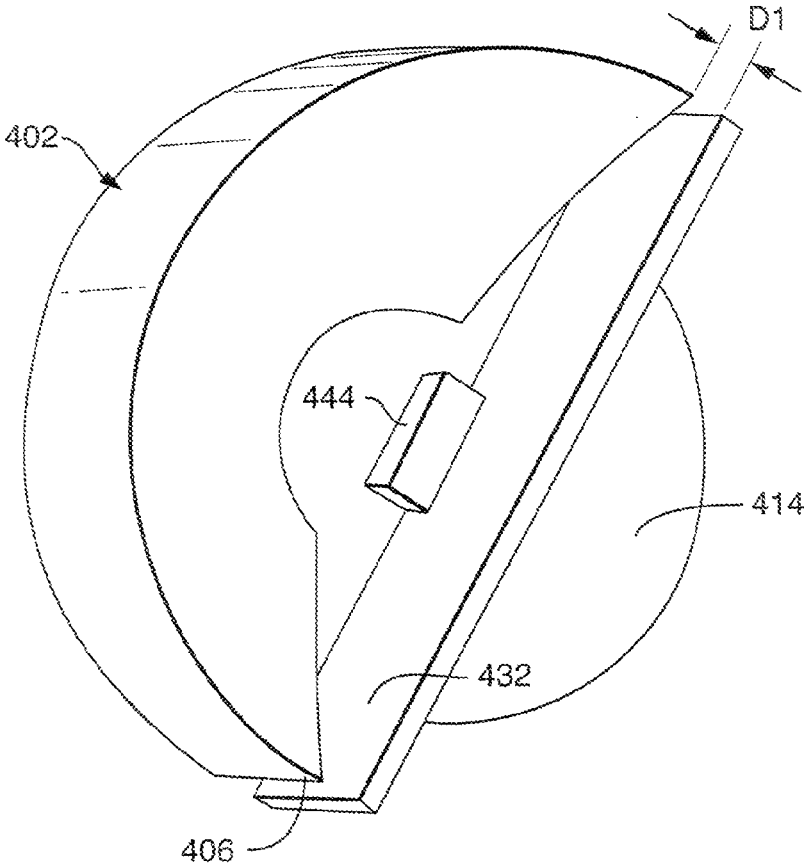
FIG. 6 is a perspective view of a portion of the lamp assembly shown in FIG. 5.

FIG. 7 includes an exemplary plot 900 of light output intensity (candela) vs. angle (degrees) illustrating the simulated performance of a lamp according to embodiments described herein including a single truncated reflector, light engine and base plate, as shown, for example, in FIG. 6. The plot 900 shown in FIG. 7 was generated with a light engine providing a 100 lumens output, a truncated reflector cup with a 30 mm diameter and approximately 17 mm length and having 90% mirror surface, and a base plate having a 99% scattering surface. The plot 900 was generated by simulating 1,000,000 light rays output from the light engine and produced a 4 Pi space efficiency (the total power with the reflector divided by the total power without the reflector) of 87.5%, indicating that 87.5% of the 100 lumens from the light engine were directed out from second end of the reflector. Also, as shown, the simulated lamp exhibits a maximum central beam candle power (CBCP) of 615 candela (cd) for the 100 lumens light engine with a beam angle at the full-width half-maximum (FWHM) luminance value (307.5 cd) of about 13 degrees. The maximum CBCP of the lamp is proportional to the output of the light source. For example, a light engine providing a 600 lumens output would produce a maximum CBCP that is six times greater than the CBCP of 615 candela shown in the plot, i.e. a 600 lumens output would produce a maximum CBCP of 3690 candela. For comparable light engine lumens output, a lamp having a configuration as shown in FIG. 6 and the parameters described above thus produced a simulated output having a significantly smaller beam angle and a significantly higher maximum CBCP compared to a conventional lamp and described in connection with FIG. 1.

Figure 9:
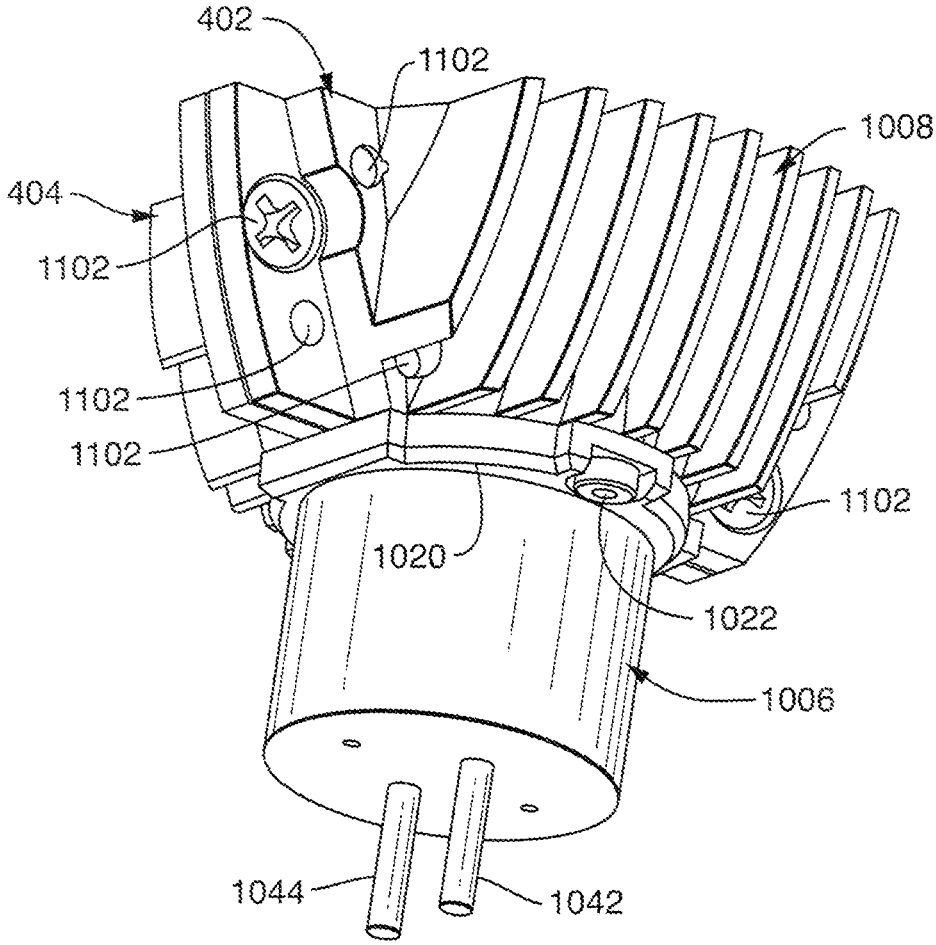
FIG. 9 is a perspective view of the lamp assembly shown in FIG. 8.

Turning now to FIGS. 8 and 9, there is shown one exemplary embodiment of a lamp assembly 1000 according to embodiments described herein. The illustrated embodiment 1000 includes first 402 and second 404 truncated reflector cups having generally semi-paraboloid interior surfaces 416, 418, first 406 and second 408 base plates positioned between the truncated reflector cups 402, 404, first 410 and second 412 light engines disposed on the base plates 406, 408, first 1002 and second 1004 lenses, and a housing 1006. As shown, the truncated reflector cups 402, 404 may be formed of a thermally conductive material and may have fins 1008, 1010 extending outwardly therefrom to dissipate heat generated by the assembly 1000. The truncated reflector cups 402, 404 may have side surfaces 420, 422 disposed against heat spreader portions 1012, 1014 of the base plates at the periphery of the assembly 1000. Heat generated by the light engines 410, 412 and electronics coupled to the base plates 406, 408 may thus be transferred through the heat spreader portions of the base plates 420, 422 to the truncated reflector cups 402, 404.

The thickness of the heat spreader portions 420, 422 may be selected to space the side surfaces 420, 422 of the truncated reflector cups 402, 404 from the top surfaces 432, 434 of the base plates 406, 408 such that the top surfaces 434, 434 lie in a plane closer to the emitting surfaces 444, 446 of the light engines 410, 412 than the top surfaces 432, 434 of the base plates 406, 408, as described in connection with FIGS. 7 and 8. The rear surfaces 436, 438 of the base plates 406, 408, respectively, may be positioned in contact with each other. The first 1002 and second 1004 lenses may cover the ends of the truncated reflector cups 402, 404 and may be supported by the base plates 406, 408. The lenses 1002, 1004 may be translucent, but may substantially protect the light engines 410, 412 and electronic components from contaminants. In some embodiments, the lenses 1002, 1004 may be transparent, opaque, or a combination thereof, including but not limited to having a particular shade of color.

The base plates 406, 408 may be secured to each other and to the truncated reflector cups 402, 404 and/or may be secured to the base plates 406, 408 by associated fasteners 1102, as shown for example in FIG. 9. The housing 1006 may be generally cylindrical with a radially extending flange 1020 at a top thereof, though in some embodiments, may have other shapes. The flange 1020 may be secured to each of the truncated reflector cups 402, 404 by fasteners 1022.

Electrical leads 1024, 1026 may extend from the light engines 410, 412 on the base plates, through corresponding openings 1030 in flat bottom portions 1032, 1034 of the truncated reflector cups 402, 404 and into a cavity 1036 defined by the housing. The electrical leads 1024, 1026 may be coupled to an optional known ballast circuit 1040. Input electrical leads 1042, 1044 may be coupled to the ballast circuit 1040 and extend outward from the housing 1006 for coupling an electrical power source 1046 to the ballast circuit 1040. As is known, the ballast circuit 1040 may receive an electrical input from the power source 1046 and convert it to a stable output for driving the light engines 410, 412. In another embodiment, a ballast circuit 1040 may be positioned remotely from the housing 1006 and the output of the ballast circuit 1040 may be coupled to the input leads 1042, 1044 with the electrical leads 1024, 1026 coupled directly to the input leads 1042, 1044.

Figure 10:
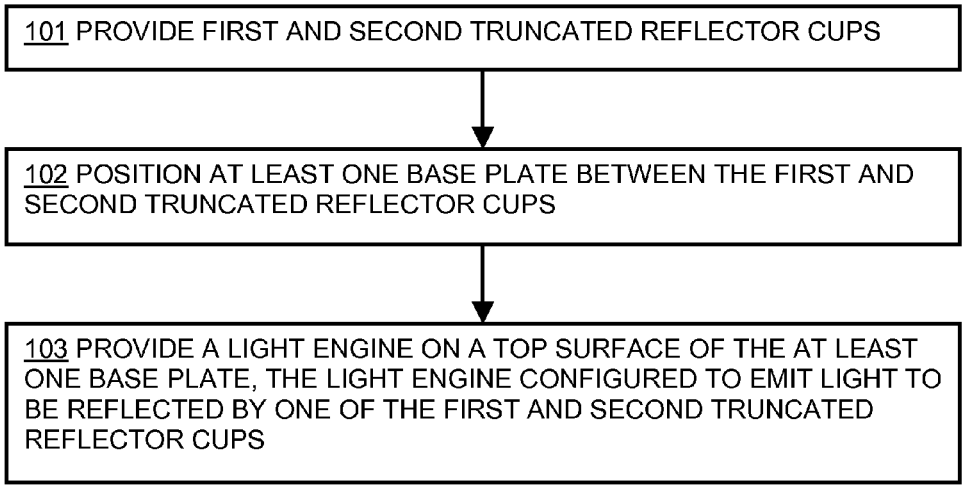
FIG. 10 is a flowchart of a method according to embodiments described herein.

FIG. 10 shows a flowchart of a method of assembling a lamp according to embodiments described herein. In FIG. 10, first and second truncated reflector cups are provided, step 101, wherein the first and second truncated reflector cups are truncated reflector cups according to any of the embodiments described herein. At least one base plate is positioned between the first and second truncated reflector cups, step 102. Finally, a light engine is provided on a top surface of the at least one base plate, step 103, the light engine configured to emit light to be reflected by one of the first and second truncated reflector cups.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one, of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A lamp assembly comprising:

first and second truncated reflector cups;

a first base plate and a second base plate, each disposed between the first and second truncated reflector cups, wherein each base plate includes a top surface and a rear surface, and wherein the rear surface of the first base plate and the rear surface of the second base plate are positioned in contact with each other; and a light engine disposed on the top surface of at least one base plate, the light engine configured to emit light to be reflected by one of the first and second truncated reflector cups.

2. A lamp assembly according to claim 1, wherein the first truncated reflector cup has a first reflector cup side surface intersecting first and second associated end surfaces, and the second truncated reflector cup has a second truncated reflector cup side surface intersecting first and second associated end surfaces, and wherein the at least one base plate is disposed between the first reflector cup side surface and the second reflector cup side surface.

3. A lamp assembly according to claim 2, wherein the first reflector cup side surface is in contact with the top surface of at least one base plate.

4. A lamp assembly according to claim 2, wherein the at least one light engine comprises a light emitting diode having an emitting surface, and wherein the first reflector cup side surface is in a plane positioned closer to the emitting surface than the top surface of at least one base plate.

5. A lamp assembly according to claim 1, wherein at least one base plate comprises a thermally conductive material.

6. A lamp assembly according to claim 1, wherein the top surface of at least one base plate comprises a reflective surface configured to reflect light incident thereon.

7. A lamp assembly according to claim 1, wherein the light engine is disposed on the top surface of the first base plate and is configured to emit light to be reflected by the first truncated reflector cup, and wherein the assembly comprises a second light engine disposed on the top surface of the second base plate, the second light engine being configured to emit light to be reflected by the second truncated reflector cup.

8. A lamp assembly according to claim 1, wherein the first and second truncated reflector cups have associated generally semi-paraboloid interior surfaces.

9. A lamp assembly according to claim 1, the assembly further comprising a housing coupled to the first and second truncated reflector cups and at least one electrical lead extending from the light engine, through a bottom of at least one of the first and second truncated reflector cups and into the housing.

10. A lamp assembly according to claim 1, the assembly further comprising a housing coupled to the first and second truncated reflector cups and a ballast circuit disposed in the housing to provide an electrical output to the light engine.

11. A lamp assembly according to claim 1, the assembly further comprising a heat spreader thermally coupled to the at least one base plate.

12. A lamp assembly comprising:

first and second truncated reflector cups, the first truncated reflector cup having a first reflector cup side surface intersecting first and second associated end surfaces, and the second truncated reflector cup having a second truncated reflector cup side surface intersecting first and second associated end surfaces;

a first base plate and a second base plate, each disposed between the first truncated reflector cup side surface and the second truncated reflector cup side surface, wherein each base plate comprises a top surface and a rear surface, wherein the top surface of at least one base plate is reflective and is configured to reflect light incident thereon, and wherein the rear surface of the first base plate and the rear surface of the second base plate are positioned in contact with each other; and at least one light engine disposed on the top surface of at least one base plate, the light engine comprising at least one light emitting diode having an emitting surface positioned to emit light toward the first truncated reflector cup, the first reflector cup side surface being in a plane positioned closer to the emitting surface than the top surface of the at least one base plate.

13. A lamp assembly according to claim 12, wherein at least one base plate comprises a thermally conductive material.

14. A lamp assembly according to claim 12, wherein the light engine is disposed on the top surface of the first base plate, and wherein the assembly comprises a second light engine disposed on the top surface of the second base plate, the second light engine being configured to emit light to be reflected by the second truncated reflector cup.

15. A lamp assembly according to claim 12, wherein first and second truncated reflector cups have associated generally semi-paraboloid interior surfaces.

16. A lamp assembly according to claim 12, the assembly further comprising a housing coupled to the first and second truncated reflector cups and at least one electrical lead extending from the light engine, through a bottom of at least one of the first and second truncated reflector cups and into the housing.

17. A lamp assembly according to claim 12, the assembly further comprising a housing coupled to the first and second truncated reflector cups and a ballast circuit disposed in the housing to provide an electrical output to the light engine.

18. A method of assembling a lamp comprising:

providing first and second truncated reflector cups;

positioning a first base plate and a second base plate between the first and second truncated reflector cups, wherein each base plate comprises a top surface and a rear surface, such that the rear surface of the first base plate and the rear surface of the second base plate are positioned in contact with each other; and providing a light engine on the top surface of at least one base plate, the light engine configured to emit light to be reflected by one of the first and second truncated reflector cups.

* * * * *